US008613640B2

(12) United States Patent
Kordonski et al.

(10) Patent No.: US 8,613,640 B2
(45) Date of Patent: Dec. 24, 2013

(54) SYSTEM FOR MAGNETORHEOLOGICAL FINISHING OF SUBSTRATES

(75) Inventors: William Kordonski, Webster, NY (US); Sergei Gorodkin, Rochester, NY (US); Arpad Sekeres, Rochester, NY (US)

(73) Assignee: QED Technologies International, Inc., Aurora, IL (US)

( * ) Notice: Subject to any disclaimer, the term of this patent is extended or adjusted under 35 U.S.C. 154(b) by 434 days.

(21) Appl. No.: 12/977,180

(22) Filed: Dec. 23, 2010

(65) Prior Publication Data

US 2012/0164925 A1 Jun. 28, 2012

(51) Int. Cl.
*B24B 49/00* (2012.01)

(52) U.S. Cl.
USPC ..... 451/8; 451/113

(58) Field of Classification Search
USPC ..... 451/8, 113
See application file for complete search history.

(56) References Cited

U.S. PATENT DOCUMENTS 5,616,066 A * 4/1997 Jacobs et al. ..... 451/36
5,795,212 A * 8/1998 Jacobs et al. ..... 451/36
5,839,944 A * 11/1998 Jacobs et al. ..... 451/8
5,951,369 A * 9/1999 Kordonski et al. ..... 451/5
6,106,380 A * 8/2000 Jacobs et al. ..... 451/360
6,309,285 B1 * 10/2001 Kordonski et al. ..... 451/113
6,506,102 B2 * 1/2003 Kordonski et al. ..... 451/64
6,561,874 B1 * 5/2003 Kordonski ..... 451/38
6,955,589 B2 * 10/2005 Kordonski et al. ..... 451/60
7,156,724 B2 * 1/2007 Kordonski et al. ..... 451/113
2002/0102928 A1 * 8/2002 Kordonski et al. ..... 451/64
2007/0107182 A1 * 5/2007 Sutton ..... 29/407.05
2011/0244759 A1 * 10/2011 Sutton ..... 451/5

* cited by examiner

*Primary Examiner* — Maurina Rachuba
(74) *Attorney, Agent, or Firm* — Thomas E Omholt; Robert C Brown; Steven D Weseman

(57) ABSTRACT

A system for magnetorheological finishing of a substrate. An integrated fluid management module (IFMM) provides dynamic control of the rheological fluid properties of the MR fluid on a conventional MR finishing apparatus, and dispensing of the fluid to the wheel. A magnetically shielded chamber charged with MR fluid is in contact with the carrier wheel. A transverse line removes the spent MR fluid from the wheel as the ribbon leaves the work zone. Replenishment fluid is added to the chamber via a dripper, and preferably an electric mixer agitates MR fluid in the chamber. A grooved magnetically-shielded insert at the exit of the chamber forms a polishing ribbon on the carrier wheel as the wheel is turned. A sensor sensitive to concentration of magnetic particles provides a signal for control of MR fluid properties, particularly, water content in the MR fluid. Means is provided for cooling fluid within the chamber.

12 Claims, 5 Drawing Sheets

SYSTEM FOR MAGNETORHEOLOGICAL FINISHING OF SUBSTRATES

BACKGROUND OF THE INVENTION

1. Field of the Invention

The present invention relates to systems for magnetically-assisted abrasive finishing and polishing of substrates; more particularly, to such systems employing magnetorheological (MR) polishing fluids; and most particularly, to an improved and low-cost system wherein polishing operation does not require an MR fluid delivery system and is carried out by a magnetically stiffen polishing ribbon formed by a novel integrated fluid management module (IFMM) charged with MR polishing fluid and having sensors and MR fluid conditioning devices to provide appropriate dynamic control of MR fluid properties.

2. Background of the Invention

Use of magnetically-stiffened magnetorheological fluids for abrasive finishing and polishing of substrates is well known. Such fluids, containing magnetically-soft abrasive particles dispersed in a liquid carrier, exhibit magnetically-induced thixotropic behavior in the presence of a magnetic field. The apparent viscosity of the fluid can be magnetically increased by many orders of magnitude, such that the consistency of the fluid changes from being nearly watery to being a very stiff paste. When such a paste is directed appropriately against a substrate surface to be shaped or polished, for example, an optical element, a very high level of finishing quality, accuracy, and control can be achieved.

U.S. Pat. Nos. 5,449,313 issued Sep. 12, 1995 and 5,577,948 issued Nov. 26, 1996, both to Kordonsky et al. disclose magnetorheological polishing devices and methods.

U.S. Pat. No. 5,525,249 issued Jun. 11, 1996 to Kordonsky et al. discloses magnetorheological fluids and methods of making thereof.

U.S. Pat. Nos. 5,839,944 issued Nov. 24, 1998 and 6,106,380 issued Aug. 22, 2000, both to Jacobs et al. disclose methods and apparatus for deterministic magnetorheological finishing of substrates.

U.S. Pat. No. 5,951,369 issued Sep. 14, 1999 to Kordonski et al., the disclosure of which is hereby incorporated by reference, discloses a system for deterministic magnetorheological finishing of substrates. This patent is referred to herein as "'369."

In an exemplary MR polishing interface, a convex lens (also referred to herein as a "workpiece") to be polished is installed at some fixed distance from a moving wall, so that the lens surface and the wall form a converging gap. Typically, the lens is mounted for rotation about an axis thereof. An electromagnet, placed below the moving wall, generates a non-uniform magnetic field in the vicinity of the gap. The magnetic field gradient is normal to the wall. The MR polishing fluid is delivered to the moving wall just above the electromagnet pole pieces to form a polishing ribbon. As the ribbon moves in the field, it acquires plastic Bingham properties and the top layer of the ribbon is saturated with abrasive due to levitation of non-magnetic abrasive particles in response to the magnetic field gradient. Thereafter, the ribbon, which is pressed against the wall by the magnetic field gradient, is dragged through the gap resulting in material removal from the lens in the lens contact zone. This area is designated as the "polishing spot" or "work zone". The rate of material removal in the polishing spot can be controlled by controlling the strength of the magnetic field, the geometrical parameters of the interface, and the wall velocity.

The polishing process employs a computer program to determine a CNC machine schedule for varying the velocity (dwell time) and the position of the rotating workpiece through the polishing spot. Because of its conformability and subaperture nature, this polishing tool may finish complex surface shapes like aspheres having constantly changing local curvature.

A fundamental advantage of MRF over competing technologies is that the polishing tool does not wear, since the recirculating fluid is continuously monitored and maintained. Polishing debris and heat are continuously removed. The technique requires no dedicated tooling or special setup. Integral components of the MRF process are the MRF software, the CNC platform with programmable logic control, the MR fluid delivery and recirculating/conditioning system, and the magnetic unit with incorporated carrier surface. The carrier surface can be formed, for example, by the rim of a rotating wheel, by horizontal surface of a rotating disk, or by a continuous moving belt.

In a typical prior art magnetorheological finishing system, such as is disclosed in '369, a carrier surface is formed on a vertically-oriented non-magnetic wheel having an axially-wide rim which is undercut symmetrically about a hub. Specially-shaped magnetic pole pieces, which are symmetrical about a vertical plane containing the axis of rotation of the wheel, are extended toward opposite sides of the wheel under the undercut rim to provide a magnetic work zone on the surface of the wheel, preferably at about the top-dead-center position. The carrier surface of the wheel may be flat, i.e., a cylindrical section, or it may be convex, i.e., a spherical equatorial section, or it may be concave. The convex shape can be particularly useful as it permits finishing of concave surfaces having a radius longer than the radius of the wheel.

Mounted above the work zone is a workpiece receiver, such as a chuck, for extending a workpiece to be finished into the work zone. The chuck is programmably manipulable in a plurality of modes of motion and is preferably controlled by a programmable controller or a computer.

Magnetorheological polishing fluid, having a predetermined concentration of non-magnetic abrasive particles and magnetic particles which are magnetically soft, is extruded in a non-magnetized state, typically from a shaping nozzle, as a ribbon onto the work surface of the wheel, which carries it into the work zone where it becomes magnetized to a pasty consistency. In the work zone, the pasty MR polishing fluid does abrasive work on the substrate. The exposure of the MR fluid to air causes some evaporation of carrier fluid and a consequent concentrating of the MR fluid. Exiting the work zone, the concentrated fluid becomes non-magnetized again and is scraped from the wheel work surface for recirculation and reuse.

Fluid delivery to, and recovery from, the wheel is managed by a closed fluid delivery system as disclosed in U.S. Pat. No. '369' or by an improved system as disclosed in U.S. Pat. No. 6,955,589. MR fluid is withdrawn from the scraper by a suction pump and sent to a delivery pump tank where its temperature is measured and adjusted to aim. Recirculation from the delivery pump to the nozzle, and hence through the work zone, at a specified flow rate is accomplished by controlling the delivery pump flow rate through the use of a magnetic valve, the hydraulic resistance being controlled by feed-back signal from a flow meter.

The concentration of solids in the MR fluid as discharged onto the wheel is an important factor in controlling the rate of material removal in the work zone. Concentration control is accomplished by measurements and monitoring of fluid viscosity which correlates directly with concentration. Viscosity measurements are carried out by an in-line capillary viscometer. At a constant fluid flow rate, the pressure drop through the capillary tubing, that is, the pressure difference between the two pressure sensors, is proportional to the viscosity of the fluid. An increase in pressure drop is inferred to mean an increase in viscosity and is used to cause replenishment of carrier fluid into the MR fluid in the tempering pump tank to reduce the apparent viscosity to aim.

Several problems have been encountered in using the U.S. Pat. Nos. '369 and '589 disclosures to finish substrates.

Operation of the prior art MR finishing system requires use of a delivery system which comprises a delivery pump, a suction pump, a flow meter, a viscometer, a nozzle, pressure transducers, a pulse dampener, a magnetic valve, a chiller, and tubing. Cost of such a delivery system is significant and may constitute up to quarter of the total cost of the MR finishing system.

Recharging of the delivery system is a time-consuming process, requiring complete disassembling, cleaning of all components, re-assembly, and breaking in after charging with a fresh fluid, which lengthy procedure negatively affects productivity and flexibility of technology.

The delivery system must operate in a non-stop regime during the MR fluid's "life" in the machine. Continuous recirculation of abrasive MR fluid is required even in the intervening periods between polishing in order to avoid changes in MR fluid properties due to sedimentation of solids. Such continuous recirculation results in accelerated wear and tear of delivery system components and consumption of extra energy.

MR fluid flow rate instability (pulsations) in the delivery system due to any of several causes results in unstable removal rate and errors on the substrate surface.

To provide proper circulation of MR fluid and compatibility with different components of the delivery system, the fluid must have specific rheological/viscous properties and appropriate chemistry. This limits selection of fluid components and restricts fluid composition, for example, for greater solids concentration required for enhancement of the removal rate.

What is needed in the art is an improved, low cost, low maintenance and technologically flexible MR finishing system wherein the polishing operation does not require a prior art conventional MR fluid delivery system.

It is a principal object of the present invention to simplify an MR finishing system to reduce system construction and operating costs, increase percent runtime, improve quality of finished substrates, and increase system flexibility.

SUMMARY OF THE INVENTION

Briefly described, an improved system for magnetorheological finishing of a substrate in accordance with the present invention obviates the necessity of a prior art MR fluid delivery system.

The polishing operation is carried out conventionally by a magnetically-stiffen polishing ribbon formed by a novel integrated fluid management module (IFMM) disposed against the carrier wheel, charged with MR polishing fluid, and having sensors for iron particle concentration and fluid temperature to provide appropriate signals for dynamic control of the rheological fluid properties of the MR fluid within the IFMM and in the work zone. Preferably, apparatus is included for tempering MR fluid within the device.

The IFMM comprises a body having a magnetically shielded cavity charged with MR fluid. The MR fluid is in contact with the carrier wheel through dynamic magnetic sealing of the IFMM, as disclosed in U.S. Pat. No. 7,156,724 (referred to herein as "'724"), the relevant disclosure of which is incorporated herein by reference. The seal additionally has a magnetically-shielded insert provided with a groove defining an extruder for forming a polishing ribbon on the carrier wheel as the wheel is turned. The ribbon is formed on the wheel surface where non-affected by the magnetic field. MR fluid in the cavity is drawn out though the groove by the moving wheel surface which then transports the resulting continuous ribbon to the magnetic work zone to form a magnetized polishing tool as in the prior art. A sensor which is sensitive to concentration of magnetic particles in the fluid is installed in the cavity to provide a signal for dynamic control of MR fluid properties, particularly, to control water content in the MR fluid. The IFMM further comprises means to remove the ribbon from the wheel after the ribbon leaves the work zone and to agitate MR fluid in the cavity.

BRIEF DESCRIPTION OF THE DRAWINGS

The foregoing and other objects, features, and advantages of the invention, as well as presently preferred embodiments thereof, will become more apparent from a reading of the following description in connection with the accompanying drawings in which.

DETAILED DESCRIPTION OF THE INVENTION

Figure 1:
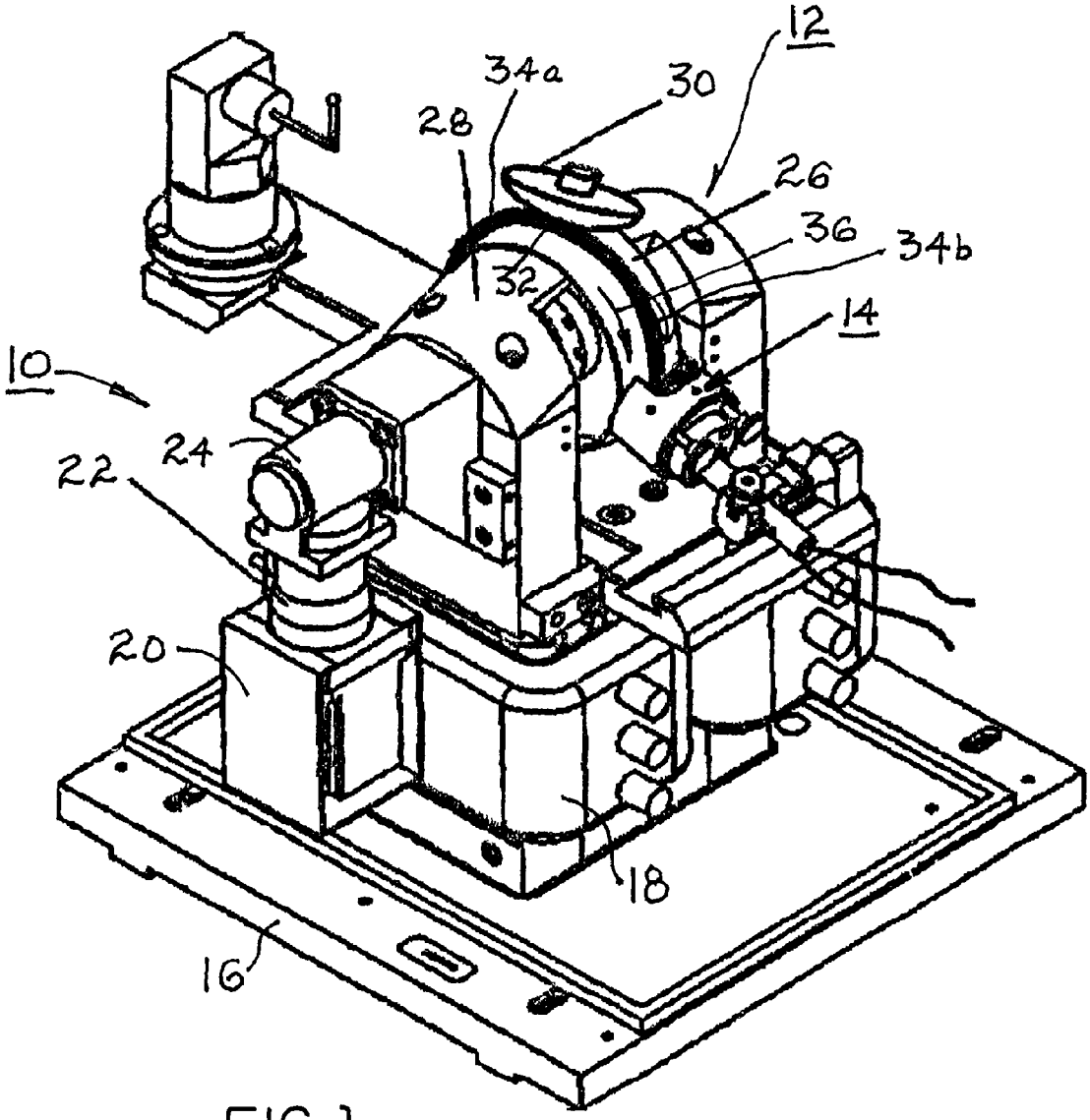
FIG. 1 is a an isometric view of an improved system for magnetorheological finishing of a substrate in accordance with the present invention.
Figure 2:
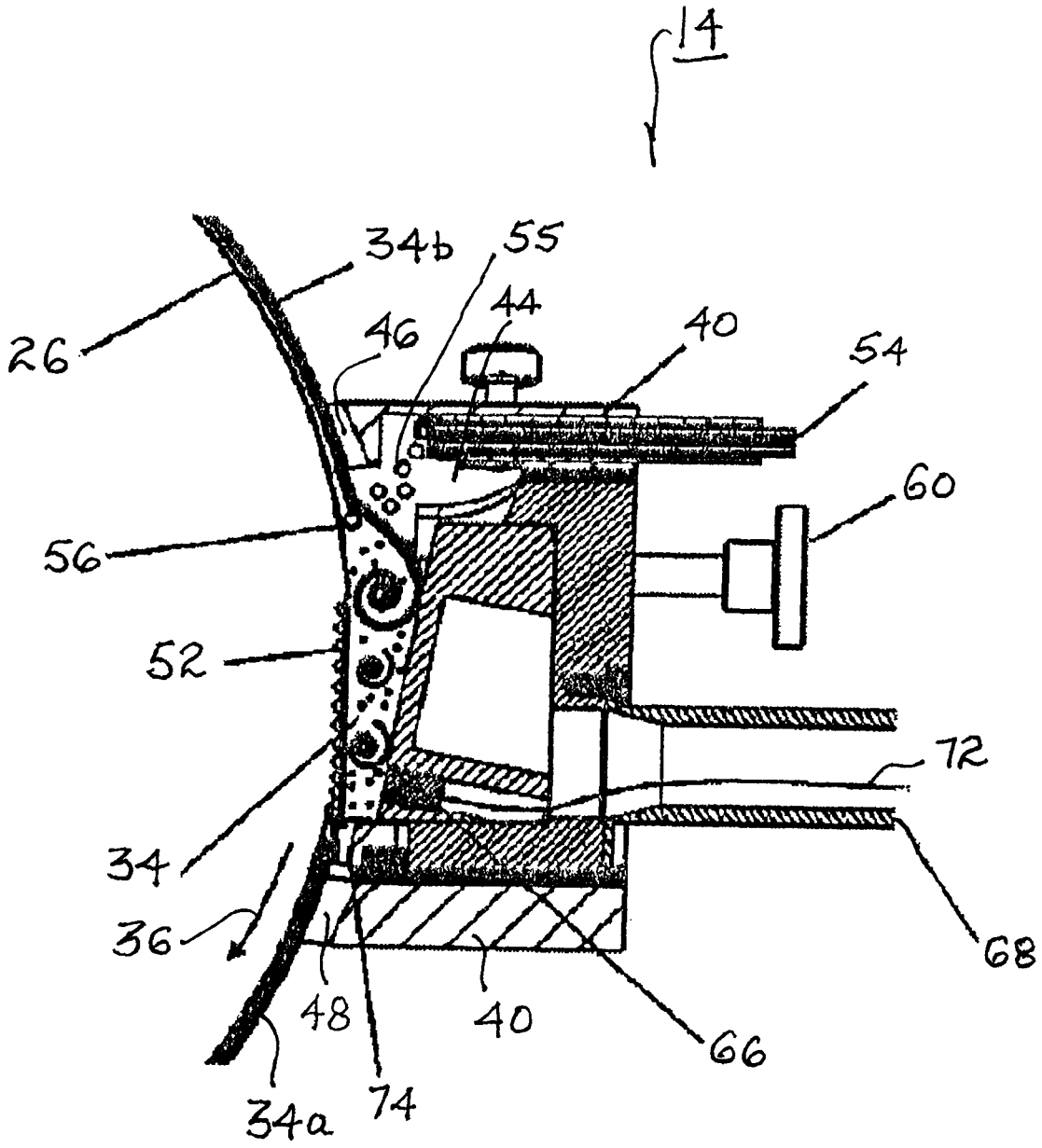
FIG. 2 is an elevational cross-sectional view of a first embodiment of a novel IFMM in accordance with the present invention, showing the module in operation against a carrier wheel carrying a ribbon of MR fluid.
Figure 3:
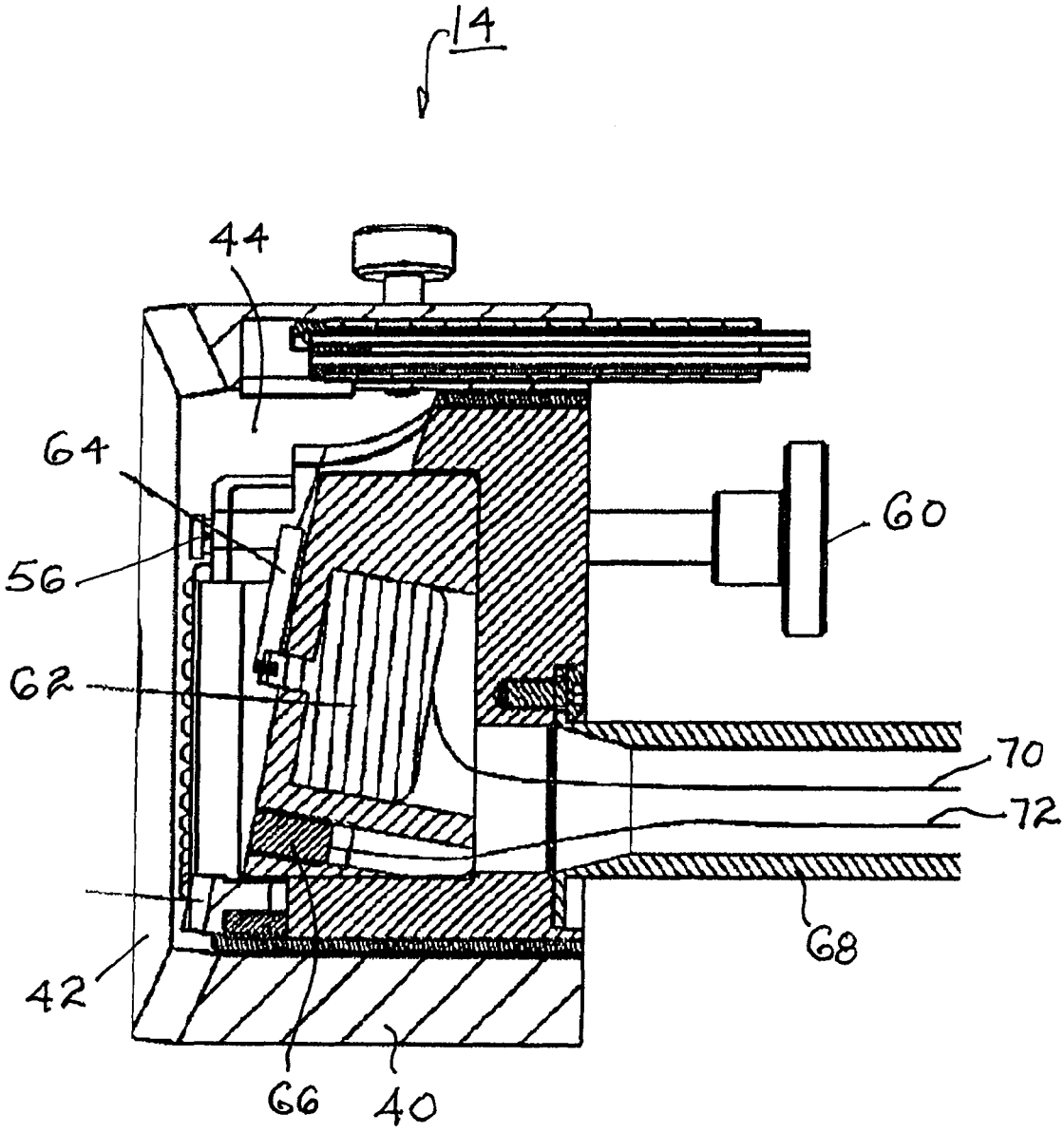
FIG. 3 is a detailed elevational cross-sectional view of the IFMM shown in FIG. 2.
Figure 4:
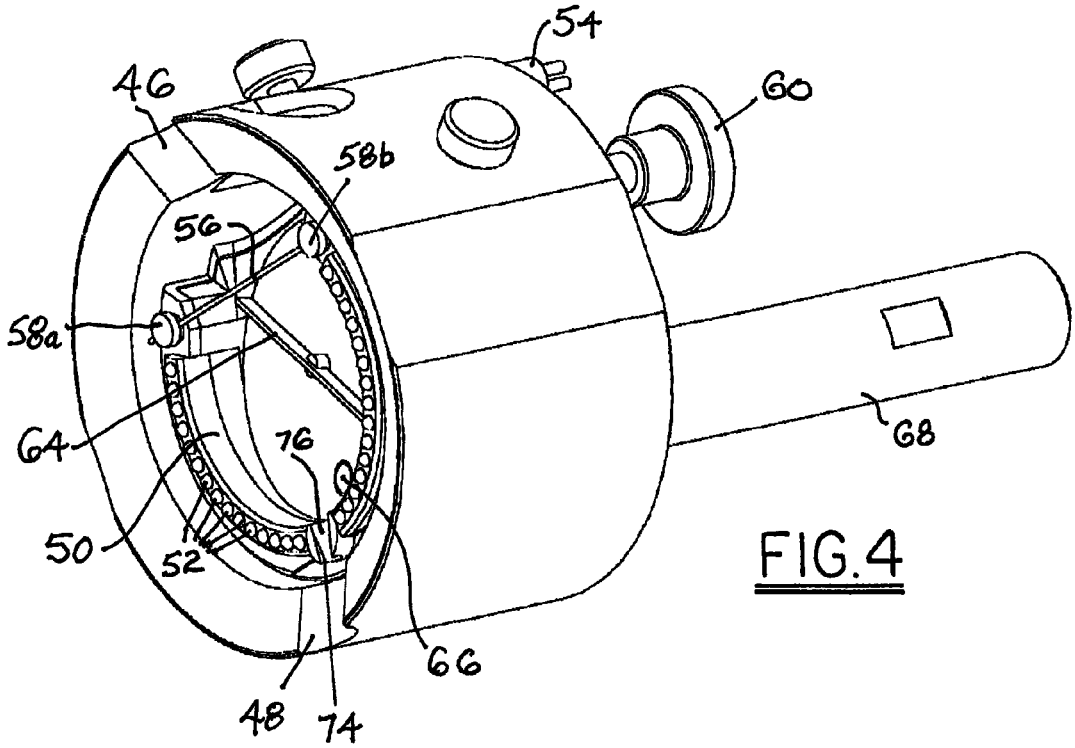
FIG. 4 is an isometric view of the IFMM shown in FIG. 2.
Figure 5:
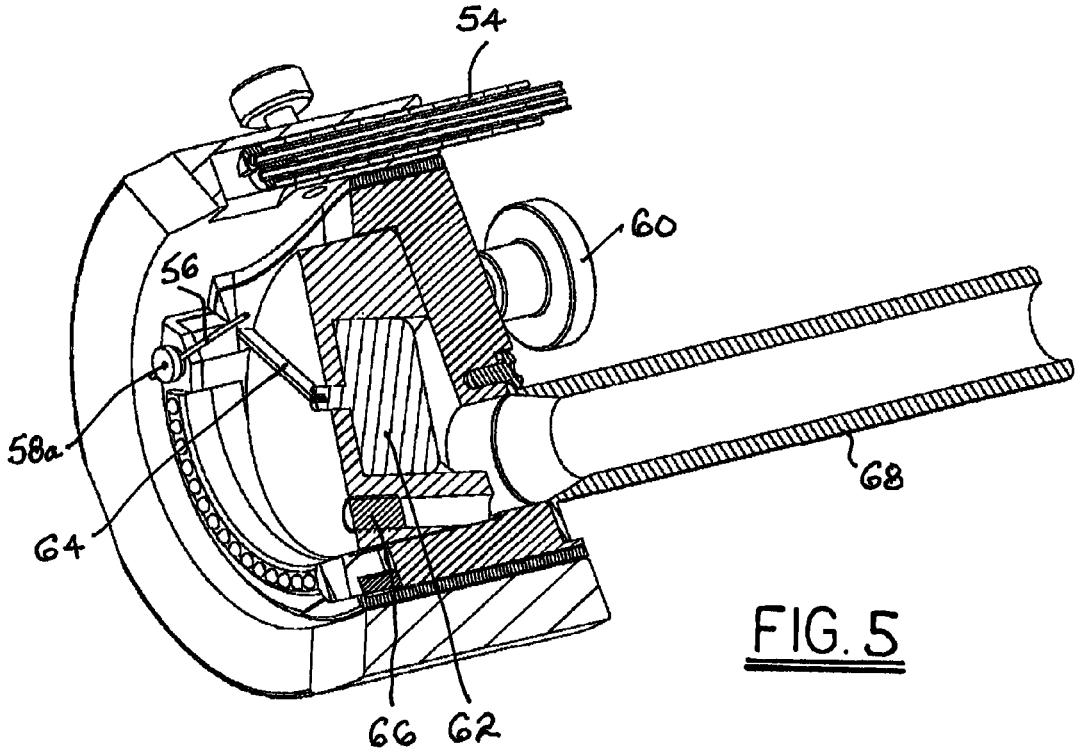
FIG. 5 is a cross-sectional view of the IFMM shown in FIG. 4.

Referring to FIG. 1, an improved system 10 for magnetorheological finishing of a substrate is shown. System 10 comprises a basic finishing apparatus 12 consistent with the prior art, and a novel IFMM 14 that exemplifies the present invention.

Prior art finishing apparatus 12 may include, for example, a platform 16, base 18, motor 20, wheel drive unit 22, wheel shaft 24, carrier wheel 26 mounted on shaft 24, and electromagnet 28. A substrate or workpiece 30 is mounted above the surface of wheel 26 at preferably the top-dead-center position, and is off-spaced from wheel 26 to create a convergent work zone 32 into which low-viscosity MR ribbon 34*a* is continuously carried by wheel 26 as the wheel is rotated by motor 20 in clockwise direction 36. Ribbon 34 is magnetorheologically stiffened to a very high pseudo-viscosity in work zone 32 by a magnetic field created by electromagnet 28. The ribbon is also carried out of work zone 32 and the magnetic field by wheel 26 and becomes a low-viscosity spent ribbon 34*b*.

MR finishing apparatus 12 in the prior art also includes an MR delivery system contained within base 18 and a fluid extrusion nozzle for applying ribbon 34*a* to the wheel, the needs for which are eliminated by IFMM 14 of the present invention. The detailed layout and arrangements of a prior art finishing apparatus are fully disclosed in the incorporated references and need not be discussed further here.

As described below, and referring now to FIGS. 1 through 5, novel IFMM 14 replaces the prior art MR fluid delivery system and extrusion nozzle. IFMM 14 is arranged to remove spent ribbon 34*b* from wheel 26, replenish and retemper the spent MR fluid, and extrude a ribbon 34*a* of replenished MR fluid onto the wheel.

IFMM 14 comprises a generally cylindrical, cup-shaped housing 40 formed of a shielding material to prevent magnetization of MR fluid within the IFMM. Housing 40 is provided with a surface 42 around the open end of housing 40 that is preferably conformable to the surface of wheel 26, e.g., in applications wherein the wheel surface is a spherical slice, surface 42 preferably is also spherical having substantially the same radius as wheel 26. Housing 40 contains a chamber 44 having an entrance slot 46 for admitting ribbon 34*b* and an exit slot 48 for dispensing extruded ribbon 34*a*. Disposed just inboard of surface 42 within housing 40 is a partial ring 50 comprising a plurality of bar magnets 52 defining a magnetic seal against MR fluid leaving chamber 44 except by being dispensed from exit slot 48, substantially as disclosed in incorporated reference '724. A dripper tube 54 provides access to chamber 44 for dispensing of fluids 55 thereinto, e.g., MR fluid, replenishment fluid, and the like. A ribbon deflector line 56 tensioned between first and second posts 58*a*,58*b* extends across the inner end of entrance slot 46 and rides in contact with the surface of wheel 26 to deflect spent ribbon 34*b* from wheel 26 into chamber 44. Line 56 is tensioned by knob 60 and may be made of nylon, stainless steel, copper, and the like. An electric mixer motor 62 and mixer impeller 64 are disposed on housing 40 and extending into chamber 44 for mixing fluids 55 with spent MR fluid 34*b* to produce replenished MR fluid 34*a* for re-use. Sensor 66 is disposed in a wall of chamber 44 in contact with mixed and replenished MR fluid 34*a* for determining the concentration of magnetic particles therein. Electrical conduit 68 permits passage of electrical leads 70,72 to motor 62 and sensor 66, respectively. A shaper insert 74 having a specially-shaped groove 76 is disposed adjacent exit slot 48 for forming the new ribbon of replenished MR fluid 34*a* on wheel 26 by extrusion from cavity 44. Insert 74 and groove 76 together define a ribbon extruder.

In operation, the magnetically-shielded (from external field) IFMM cavity 44 is charged with a given volume of MR fluid 34 (for example, by a syringe through dripper 54) while wheel 26 rotates. The surface of wheel 26 carries out the low-viscosity MR polishing fluid 34*a* through groove 76, the magnetically-shielded from neighboring magnetic pins 52, thus forming a ribbon 34*a* on the wheel surface. The groove geometry defines the shape of the ribbon, which along with the work piece plunge depth of work zone 32 affects the removal function volumetric removal rate and spot polishing resolution (a smaller spot can address smaller surface errors). Thus, the groove geometry is an important factor in controlling the shape of the ribbon and thus of system finishing performance. Groove 74 may be a modulus with different grooves or only an easily-replaceable groove insert.

Passing into work zone 32, ribbon 34*a* is magnetized by the magnetic field in the work zone, forming a polishing tool. After passing through work zone 32, the ribbon, now 34*b*, enters magnetically-shielded IFMM cavity 44, demagnetizes, and is removed from the wheel surface by a non-magnetic ribbon deflector line 56, forming a jet which along with the moving wheel surface agitates MR fluid and facilitates mixing with replenishment carrier fluid, e.g., water injected by dripper 54. Additional agitation/mixing (for example, in the case of the use of relatively viscous MR fluids) can be provided with suitable means such as an optional rotating mixer impeller 64 driven by motor 62 incorporated in the module body.

The process of ribbon formation and MR polishing fluid recovery in the IFMM cavity is continuous. Typically, water-based MR polishing fluid is used in optics finishing. Overall system stability and removal rate stability are essential for controlled, high-resolution, deterministic finishing. Material removal rate may change due to water evaporation that occurs on the ribbon surface and in the IFMM cavity. This, in turn, causes undesirable change (increase) in MR fluid solids concentration which is detected by sensor 66 incorporated in the cavity wall. A signal from sensor 66 feeds a conventional feed-back loop (controller, not shown) to activate a water injector (not shown) to inject some specific amount of water required to maintain aim concentration of solids.

Figure 6:
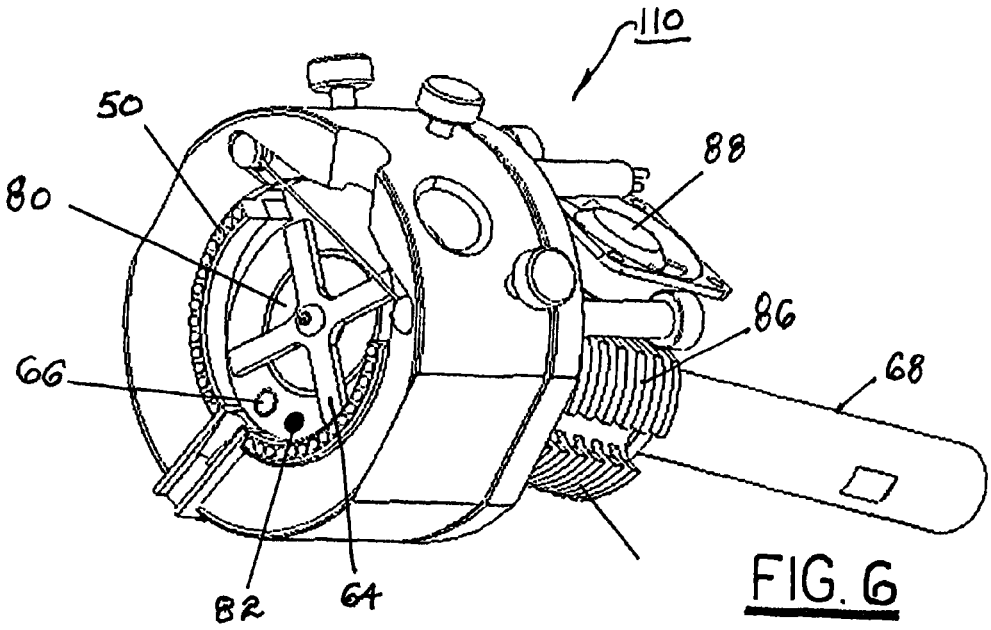
FIG. 6 is an isometric view of a second embodiment of an IFMM in accordance with the present invention.
Figure 7:
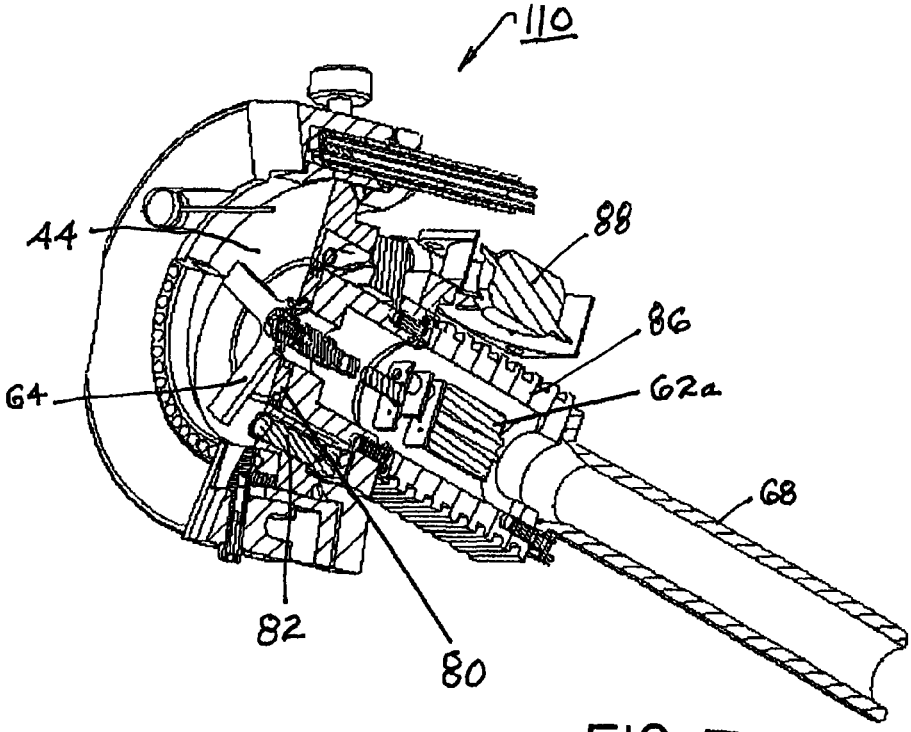
FIG. 7 is a cross-sectional view of the IFMM shown in FIG. 6.

Referring now to FIGS. 6 and 7, a second embodiment 110 of an IFMM in accordance with the present invention is shown.

In work zone 32, high-viscosity MR polishing fluid 34 undergoes high shear which may generate appreciable heat. An increase in MR fluid temperature is not desirable because it may affect fluid properties and, in turn, removal rate. To provide heat removal and maintain constant fluid temperature, a chiller 80, preferably cylindrical, is mounted at the rear of cavity 44. A currently preferred chiller is a thermo-electric Peltrier element available, for example, from TE Technology Inc., Traverse City, Mich., USA. Obviously, other means for tempering liquids are fully comprehended by the present invention. A temperature sensor 82, e.g., a conventional thermocouple, thermistor, or the like, is installed in the cavity. One wall of element 80 is in contact with fluid 34 in chamber 44 and the opposite wall is in contact with a cylindrical heat sink 84 having fins 86, mounted to the rear of chamber 44 and containing mixer motor 62*a*. An external fan 88 cools fins 86. A signal from temperature sensor 82 conventionally feeds a feedback loop (not shown) to regulate (with a controller, not shown) an output of DC power supply (not shown) which provides electric current through the Peltier element 80. In doing so, a certain temperature of the wall in contact with MR fluid 34 is maintained, which in turn provides required heat removal from MR fluid 34 and a specified constant fluid temperature. Obviously other chiller arrangements may be used, as desired.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. An integrated fluid management module for use in a magnetorheological finishing system having a carrier wheel, comprising:

a) a housing having a magnetically-shielded chamber therein, said chamber having an opening to a surface of said carrier wheel, wherein said housing is disposed in close proximity to said surface of said carrier wheel;

b) apparatus for receiving from said wheel and replenishing spent magnetorheological fluid within said chamber; and c) an exit groove in said housing connected to said chamber defining a ribbon extruder for extruding a ribbon of replenished magnetorheological fluid from said chamber onto said wheel surface, wherein the proximity of said carrier wheel surface to said exit groove causes said magnetorheological fluid to flow directly from said chamber onto said wheel surface.

2. A system in accordance with claim 1 further comprising a seal between said housing and said wheel surface.

3. A system in accordance with claim 2 wherein said seal partially surrounds said opening.

4. A system in accordance with claim 2 wherein said seal comprises a plurality of bar magnets.

5. A system in accordance with claim 1 further comprising a mixer impeller disposed in said chamber.

6. A system in accordance with claim 5 wherein said mixer impeller is powered by an electric motor.

7. A system in accordance with claim 1 further comprising a ribbon deflector line disposed on said housing for directing spent magnetorheological fluid from said wheel surface into said chamber.

8. A system in accordance with claim 1 further comprising means for supplying replenishment fluid to said chamber.

9. A system in accordance with claim 1 further comprising a sensor for sensing concentration of magnetic particles in magnetorheological fluid in said chamber.

10. A system in accordance with claim 1 further comprising a sensor for sensing temperature of magnetorheological fluid in said chamber.

11. A system in accordance with claim 1 further comprising apparatus disposed on said housing for cooling said magnetorheological fluid within said chamber and for dissipating heat therefrom.

12. A system for magnetorheological finishing of substrates by a magnetorheological fluid, comprising:

a) a carrier wheel;

a) a pair of substantially mirror-image magnetic pole pieces disposed in opposition to each other on opposite sides of said carrier wheel for creating a magnetic field in a work zone wherein said magnetorheological fluid is magnetically stiffened; and c) an integrated fluid management module, including a housing having a magnetically-shielded chamber therein, said chamber having an opening to a surface of said carrier wheel, wherein said housing is disposed in close proximity to said surface of said carrier wheel, apparatus for receiving from said wheel and replenishing spent magnetorheological fluid within said chamber, and an exit groove in said housing defining a ribbon extruder for extruding a ribbon of replenished magnetorheological fluid directly from said chamber onto said wheel surface.

* * * * *